US009499369B2

(12) United States Patent
Billman et al.

(10) Patent No.: US 9,499,369 B2
(45) **Date of Patent: *Nov. 22, 2016**

(54) CONTINUOUS FEED MATERIAL DISPENSER WITH ADJUSTABLE BRAKE

(71) Applicant: SCA TISSUE NORTH AMERICA LLC, Philadelphia, PA (US)

(72) Inventors: Craig Billman, Phoenixville, PA (US); Jeffrey J. Brickl, Lodl, WI (US);
(Continued)

(73) Assignee: SCA TISSUE NORTH AMERICA LLC, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/071,161

(22) Filed: Nov. 4, 2013

(65) Prior Publication Data

US 2014/0061355 A1 Mar. 6, 2014

Related U.S. Application Data

(63) Continuation of application No. 13/471,687, filed on May 15, 2012, now Pat. No. 8,616,486, which is a
(Continued)

(51) Int. Cl.
*A47K 10/38* (2006.01)
*B65H 23/188* (2006.01)

(52) U.S. Cl.
CPC ..... *B65H 23/188* (2013.01); *A47K 10/3818* (2013.01); *A47K 10/3827* (2013.01); *Y10T 74/19637* (2015.01)

(58) Field of Classification Search
USPC ..... 242/579, 580, 580.1, 585, 593, 419.9, 242/419.8, 419.5, 419.4, 419; 225/11, 15,
(Continued)

(56) References Cited

U.S. PATENT DOCUMENTS 1,746,582 A 2/1930 Elder
5,118,011 A 6/1992 Kopp
(Continued)

FOREIGN PATENT DOCUMENTS

CN 1678228 A 10/2005
GB 487551 A 6/1938
WO WO-97/26818 7/1997

OTHER PUBLICATIONS

Chinese Office Action dated Aug. 30, 2013 issued in corresponding patent application No. 201080016678.9 (with English translation) (9 pages).

(Continued)

*Primary Examiner* — Sang Kim
*Assistant Examiner* — Juan Campos, Jr.
(74) *Attorney, Agent, or Firm* — Drinker Biddle & Reath LLP

(57) ABSTRACT

A braking assembly used in a dispenser that dispenses a continuous supply of material such as paper. The braking assembly includes a support structure. A first fixed gear is rotatably connected to the support structure. A movable chassis is also connected to the support structure. A second movable gear is held by the chassis and moves with the chassis. Teeth of the first gear and teeth of the second gear intermesh with each other and allow the paper to pass therethrough. The chassis maintains the teeth of the first and second gears in contact with each other while enabling a distance between gears to be adjustable. The assembly further includes a braking mechanism that varies an amount of force required to rotate the gears.

19 Claims, 5 Drawing Sheets

(72) Inventors: Wayne Hansen, Poynette, WI (US);
Edward A. Raleigh, Lodl, WI (US);
Rodney Wilson, Wilmington, DE (US);
John W. Grosz, Waupun, WI (US)

Related U.S. Application Data continuation of application No. 12/423,290, filed on Apr. 14, 2009, now Pat. No. 8,256,700.

(58) Field of Classification Search
USPC ..... 225/52, 79, 106
See application file for complete search history.

(56) References Cited

U.S. PATENT DOCUMENTS

| | | | |
|---|---|---|---|
| 5,282,585 | A | 2/1994 | Takatori |
| 5,452,832 | A | 9/1995 | Niada |
| 5,577,634 | A | 11/1996 | Morand |
| 6,089,401 | A | 7/2000 | Salåker |
| 6,695,247 | B2 | 2/2004 | Widlund |
| 6,769,589 | B2 | 8/2004 | Paukov |
| 7,347,134 | B2 | 3/2008 | Lewis et al. |

OTHER PUBLICATIONS

Examination Report dated Jan. 26, 2015 issued in corresponding European patent application No. 10 706 407.3 (5 pages).

CONTINUOUS FEED MATERIAL DISPENSER WITH ADJUSTABLE BRAKE

CROSS REFERENCE TO RELATED APPLICATIONS

This application is a continuation application of copending application Serial number: copending U.S. patent application Ser. No. 13/471,687, filed May 15, 2012, which is a continuation of U.S. patent application Ser. No. 12/423,290, filed Apr. 14, 2009, now U.S. Pat. No. 8,256,700 issued Sep. 4, 2012. The entire contents of each of these applications are incorporated by reference herein in their entirety.

FIELD OF THE INVENTION

The present invention relates to a braking assembly for a continuous feed material dispenser.

BACKGROUND OF THE INVENTION

Continuous feed material dispensers often dispense from a central location at the bottom of the dispenser. Usually the material being dispensed is a paper material, such as paper towel wound onto a roll. The roll of paper towel might be perforated to assist in determining a length of material dispensed.

In regards to perforated center-feed paper towel dispensing, most prior art dispensers use a funnel shaped orifice that acts as a brake by controlling the tension on the towel as it is dispensed. See, for example, U.S. Pat. No. 6,769,589 to Paukov.

As a towel is pulled from the dispenser, it is forced through an opening that becomes increasingly narrower which requires an increase in the force applied by the user to pull the towel through the narrow end. The orifice is sized such that the force applied by the user to remove the towel increases to an amount higher than the perforation strength of the towel or web material. Continued pulling causes the web to break and provides the user with a single section of towel.

One problem with this method of dispensing is that the orifice needs to be sized to match the properties of the web material being used and it is not easily adjusted to adapt to materials with different properties. Another problem, due to small variations inherent in the manufacturing of web materials (perforation tensile strength, paper weight, etc.) as well as other external factors, is that it is possible that a sheet of material breaks off from the continuous source of the material at a point within the funnel such that it does not leave any additional material protruding from the orifice for the next user to pull.

These types of dispensers can also be difficult to load once the web has been broken or when the supply of material has been exhausted and a new supply must be loaded. The person responsible for reloading the dispenser must try and push a section of the flexible web material through the funnel, at which point the material tends to bunch up on itself as more material is pushed in to move it along the funnel. As more material is fed in and it reaches the narrower end of the funnel, this bunching can effectively clog the orifice the user is trying to load into.

SUMMARY OF THE INVENTION

It is therefore, an object of the present invention to provide a braking assembly for a continuous feed material dispenser that addresses and ameliorates, in whole or in part, one or more of the above-noted disadvantages.

The dispenser according to the invention utilizes two feed gears. In a presently preferred embodiment, one gear is rigidly mounted and the other is moveably mounted to a chassis which is spring loaded to keep the gears meshed together without jamming, regardless of the basis weight of the paper.

Additionally, in a presently preferred embodiment, the braking assembly utilizes an adjustable brake which can be used to increase the amount of force required to turn the feed gears, thereby allowing a user to adjust the dispenser to the appropriate force level for the perforation strength of the material being dispensed.

BRIEF DESCRIPTION OF THE DRAWINGS

Preferred embodiments of the invention will be described by way of example with reference to the attached drawings, in which.

DETAILED DESCRIPTION OF EMBODIMENTS

Figure 1:
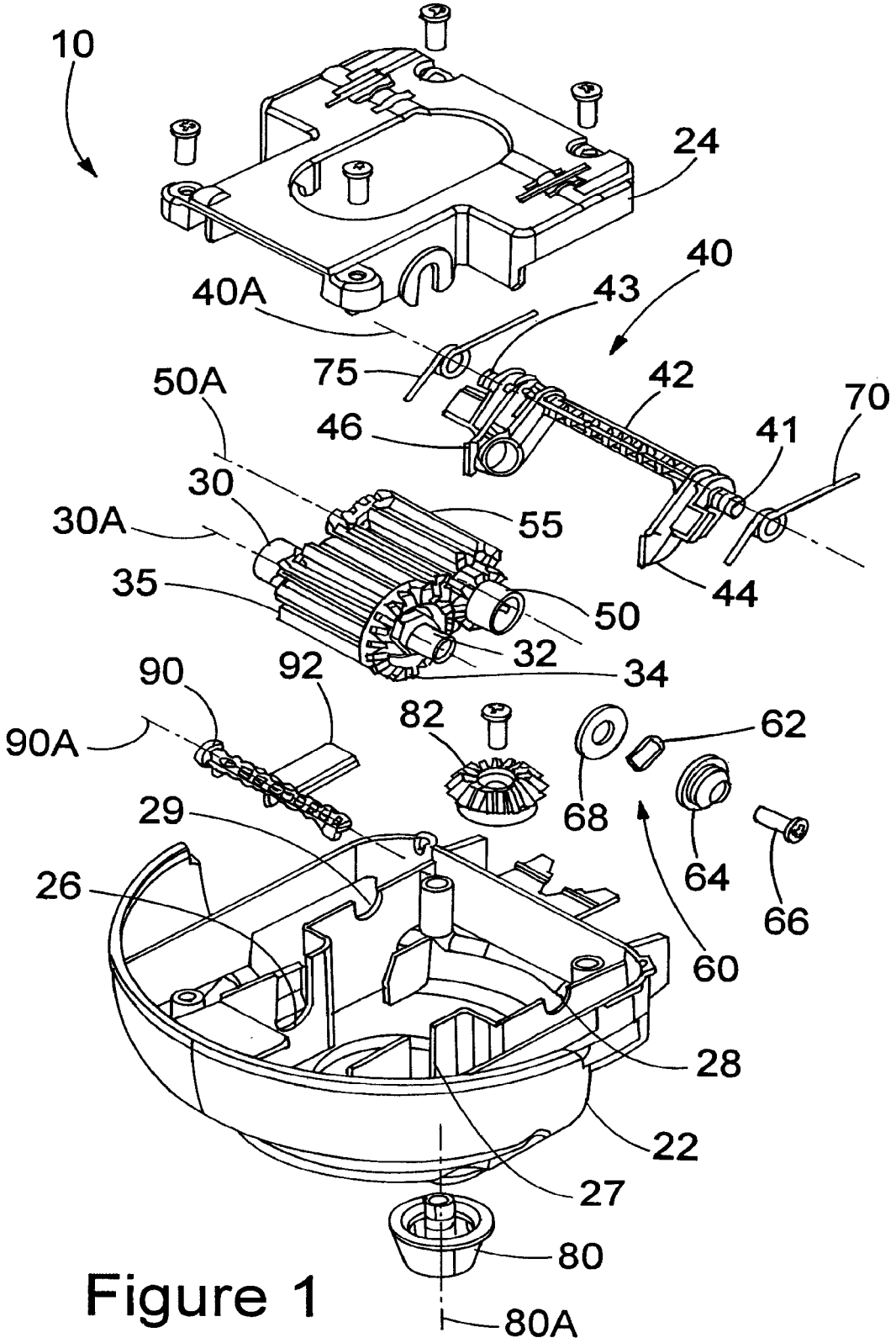
FIG. 1 is an exploded perspective view of components of an embodiment of a braking assembly.

In the drawings, reference numeral 10 denotes a braking assembly according to the present invention. The braking assembly 10 is connected to a dispenser main housing (not shown). The main housing is configured to hold a supply of continuous feed material that is to be dispensed from the main housing. As recognized by those of ordinary skill in the art, the term "continuous feed material" includes paper, non-woven webs and other absorbent web material. This feed material might be wound in a roll or might be folded. The feed material might also be perforated or non-perforated. For the sake of convenience, the term "paper" is used below. However, the present invention is not limited to such material and each of the above noted materials and other feed materials known in the dispensing art are contemplated by the invention.

Figure 2:
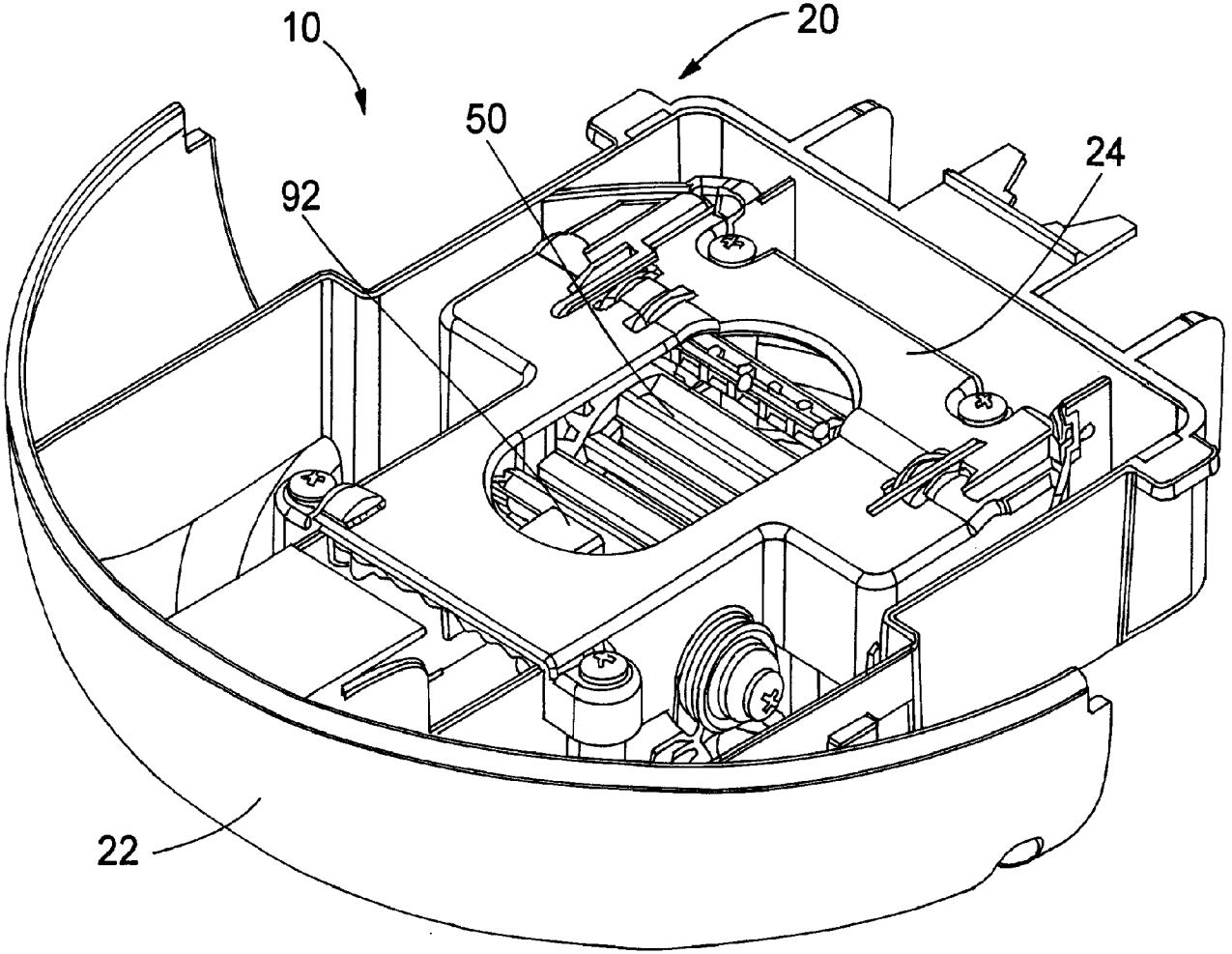
FIG. 2 is a perspective view from above of the FIG. 1 embodiment assembled in a dispenser.

In the embodiment of FIG. 1, the braking assembly 10 includes a braking assembly housing 20 (see FIG. 2) having a lower assembly housing 22 and an upper assembly housing 24.

A first gear 30 is mounted in the braking assembly housing 20. The first gear 30 rotates about a first axis 30A that extends longitudinally through a center of the first gear 30. The first gear 30 includes a rotation axle 32 that enables rotation of the first gear 30 about the first axis 30A in axle support 26, 27 in the lower assembly housing 22.

The lower assembly housing 22 also supports a chassis 40 at chassis supports 28, 29. In a presently preferred embodiment, the chassis 40 is pivotally mounted in chassis supports 28, 29 via first and second chassis ends 41, 43. However, the chassis 40 might also be mounted for linear movement, or might move by a combination of linear and pivoting motion. The chassis 40 preferably includes an elongate main body 42 having the first and second ends 41, 43 and first and second arms 44, 46 extending substantially perpendicular to the elongate main body 42.

A second gear 50 is mounted on the chassis 40 between the first and second arms 44, 46. The second gear 50 rotates about a second axis 50A that is parallel to the first axis 30A. In a presently preferred embodiment, the chassis 40 pivots about a third axis 40A spaced apart from and parallel to the second axis 50A. The second gear 50 has teeth 55 that intermesh with teeth 35 of the first gear 30. An example of intermeshing teeth is disclosed in applicant's U.S. Pat. No. 6,089,401, the entirety of which is hereby expressly incorporated by reference.

The chassis 40 is configured to maintain the first and second gears 30, 50 adjacent to each other while enabling a distance between the first and second gears 30, 50 to be adjustable by the second gear 50 moving with the chassis 40. In a presently preferred embodiment, torsions springs 70, 75 are connected to the first and second ends 41, 43 of the main body 42. The torsion springs 70, 75 bias the chassis 40 so as to maintain the first gear 30 and the second gear 50 adjacent to each other. Such configuration of the chassis 40 enables a distance between the gears to be changed while the teeth 35, 55 are still engaged. This arrangement allows paper of varying thickness to flow through the first and second gears 30, 50 without jamming.

In a presently preferred embodiment, the configuration of the axle support 26 is such that the first gear 30 is prevented from movement except in rotation. In this embodiment, the above-noted chassis configuration enables the second gear 50 to move with the chassis 40. However, the present invention contemplates that either or both gears 30, 50 are movable in directions other than in rotation.

FIG. 1 further shows a brake mechanism 60. The brake mechanism 60 controls the amount of force required to spin the gears. In a presently preferred embodiment, the brake mechanism varies the force required to spin the first gear 30 and is adjustable throughout from a relatively low to a relatively high amount of force such that the brake mechanism 60 can accommodate paper product of various perforation strengths. The brake mechanism 60 can also be used to set a force such that the dispenser will dispense one segment of a continuous perforated sheet of paper or can be set to a lower force such that multiple segments can be removed without breaking the perforated material. The break force can be adjusted to meet the customers' requirements for consumption with multiple varieties of paper of various perforation strengths.

Figure 5:
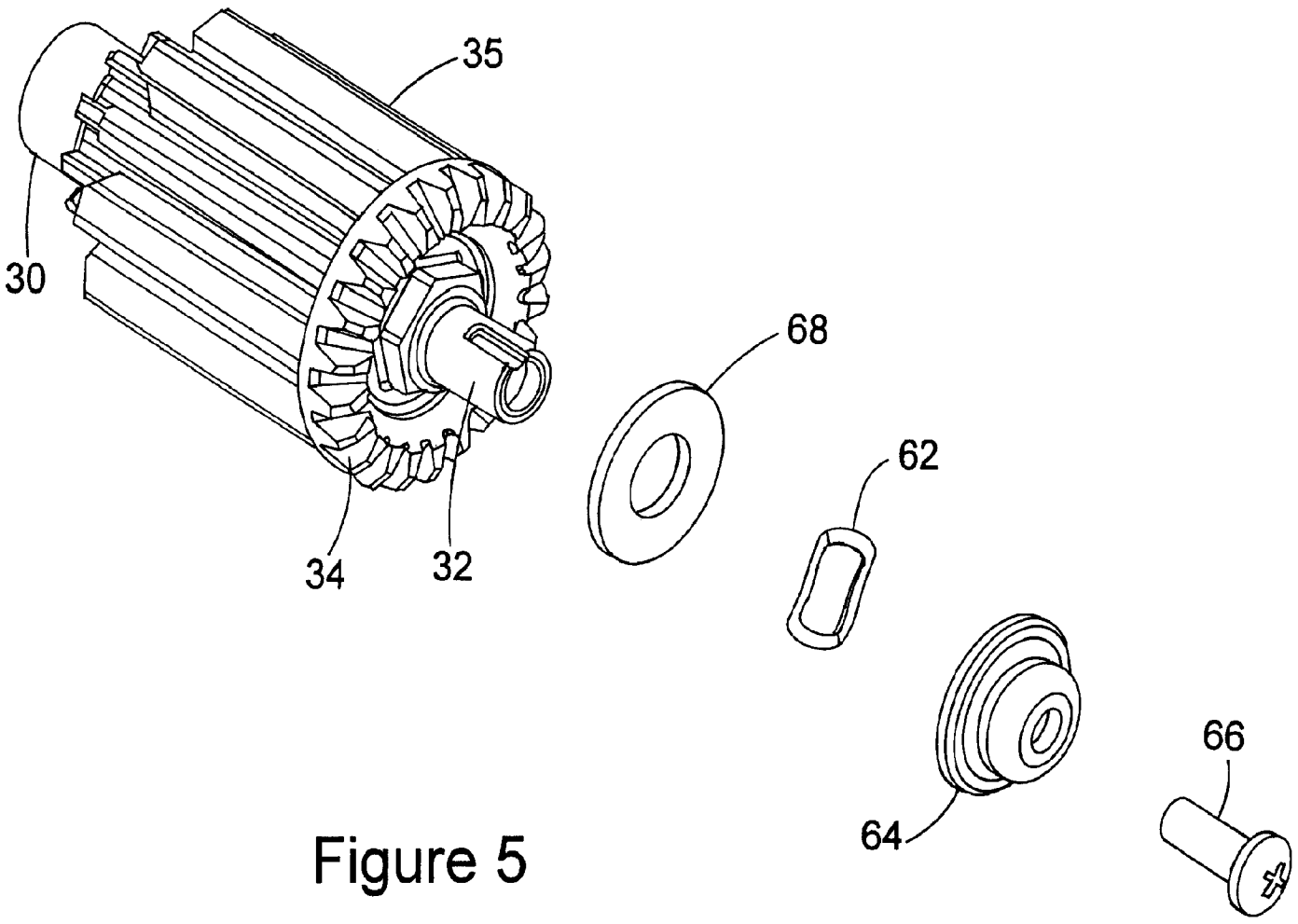
FIG. 5 is a perspective view of the braking assembly of the FIG. 1 embodiment.

In the presently preferred embodiment, the brake mechanism 60 includes a wave washer 62 as seen in FIG. 5 mounted over the axle 32 of the first gear 30. The wave washer 62 is held captivate between axle support 27 and a hub 64 on the end of the axle 32. The brake mechanism 60 is held in place by a screw 66 threaded into the axle 32. A flat portion on the underside of the head of the screw 66 abuts against the hub 64.

Adjusting a length of thread engagement on the screw causes the wave washer 62 to compress or allows it to expand. Increasing the thread engagement causes the wave washer 62 to compress and increases the axial force on the first gear 30, which in turn requires a higher force to rotate the first gear 30. Similarly, decreasing the screw engagement allows the wave washer 62 to expand and decreases the axial force on the first gear 30 allowing the first gear 30 to rotate more freely.

In other embodiments, the wave washer 62 might be replaced by a spring or a piece of resilient material 68 or any combination of these might be used such as would have the same effect of modifying the force required to rotate the gear through the compression and expansion of the resilient material. Additional components can be used to sandwich the resilient material to increase lubricity between the resilient material and the surfaces which hold the resilient material captive therebetween to reduce wear and extend the life of the braking mechanism 60.

In the presently preferred embodiment, the braking mechanism 60 is connected to the first gear 30. However, a braking mechanism might be connected to either the first gear 30 or the second gear 50. Also, in other embodiments a brake mechanism could be installed on any other component in the "drive train" of the braking assembly 10 so long as the end effect would result in controlling the amount of force required for rotating the gears.

In one embodiment of the invention, there is a manual feed knob 80 that allows the user to advance the paper if the perforation breaks within the feed gears and there is no "tail" left showing for the next portion of paper. The manual feed knob 80 might also be used to ease loading of the leading end of a fresh roll of material through the braking assembly 10. In a presently preferred embodiment, the manual feed knob 80 turns along an axis 80A perpendicular to the axes of rotation 30A, 50A for the first and second gears 30, 50. This is accomplished utilizing a bevel gear train comprising beveled gear 82 of the manual feed knob 80 and beveled gear 34 of the first gear 30. This setup allows a narrower profile for the dispenser as well as utilizing a gear ratio to optimize the force required to actuate the manual feed knob 80 for ergonomic factors.

In alternative embodiments, the feed knob might rotate along an axis parallel with the first and second gears 30, 50 either through a gear train or by direct attachment to one of the first and second gears 30, 50. Additionally, the manual feed knob 80 might be shaped in such a way that an end user can only gain an effective grip on the knob for turning in the prescribed direction.

Figure 3:
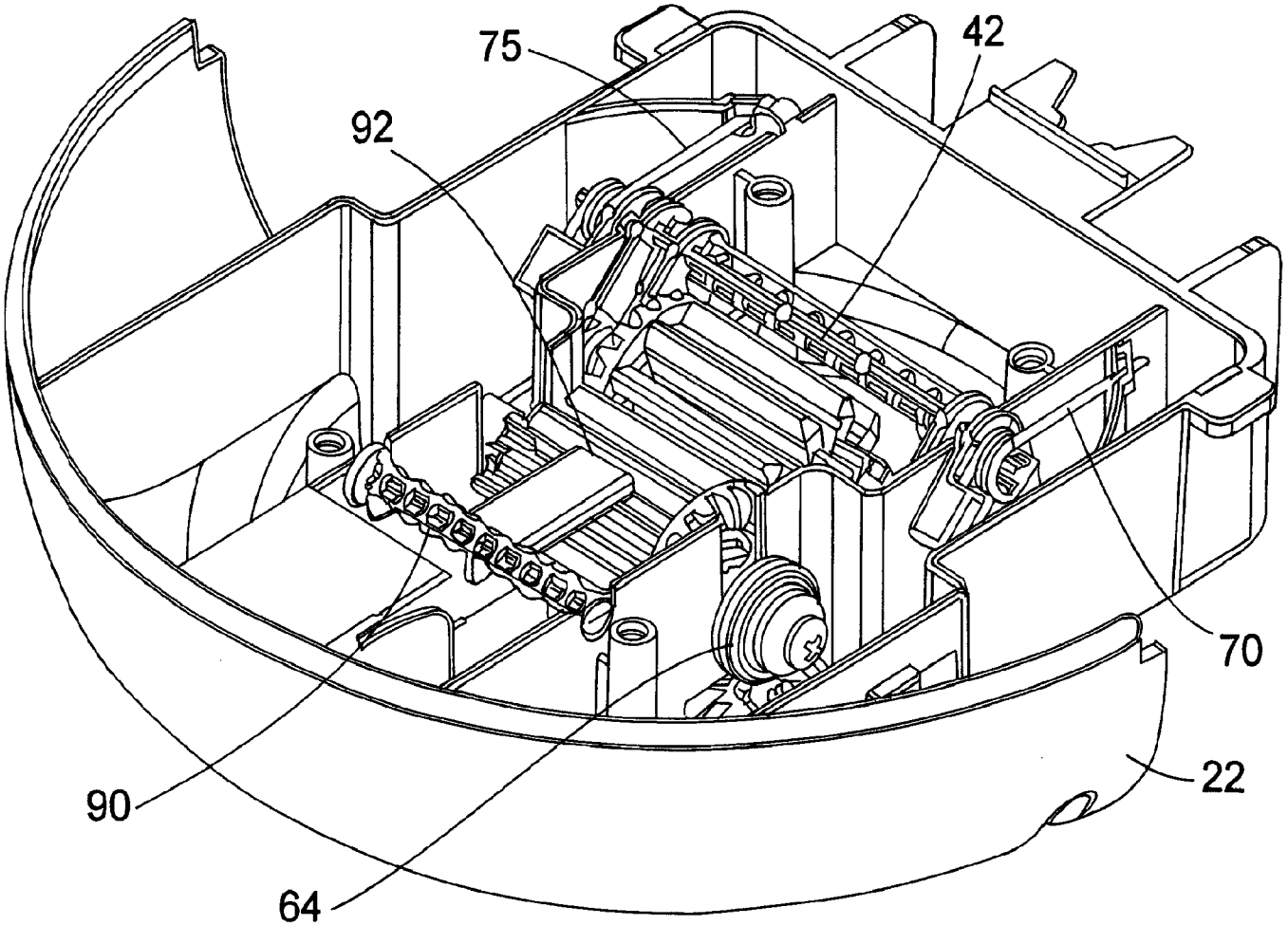
FIG. 3 is a perspective view from above of the FIG. 1 embodiment assembled in a dispenser, with certain parts removed for clarity.
Figure 4:
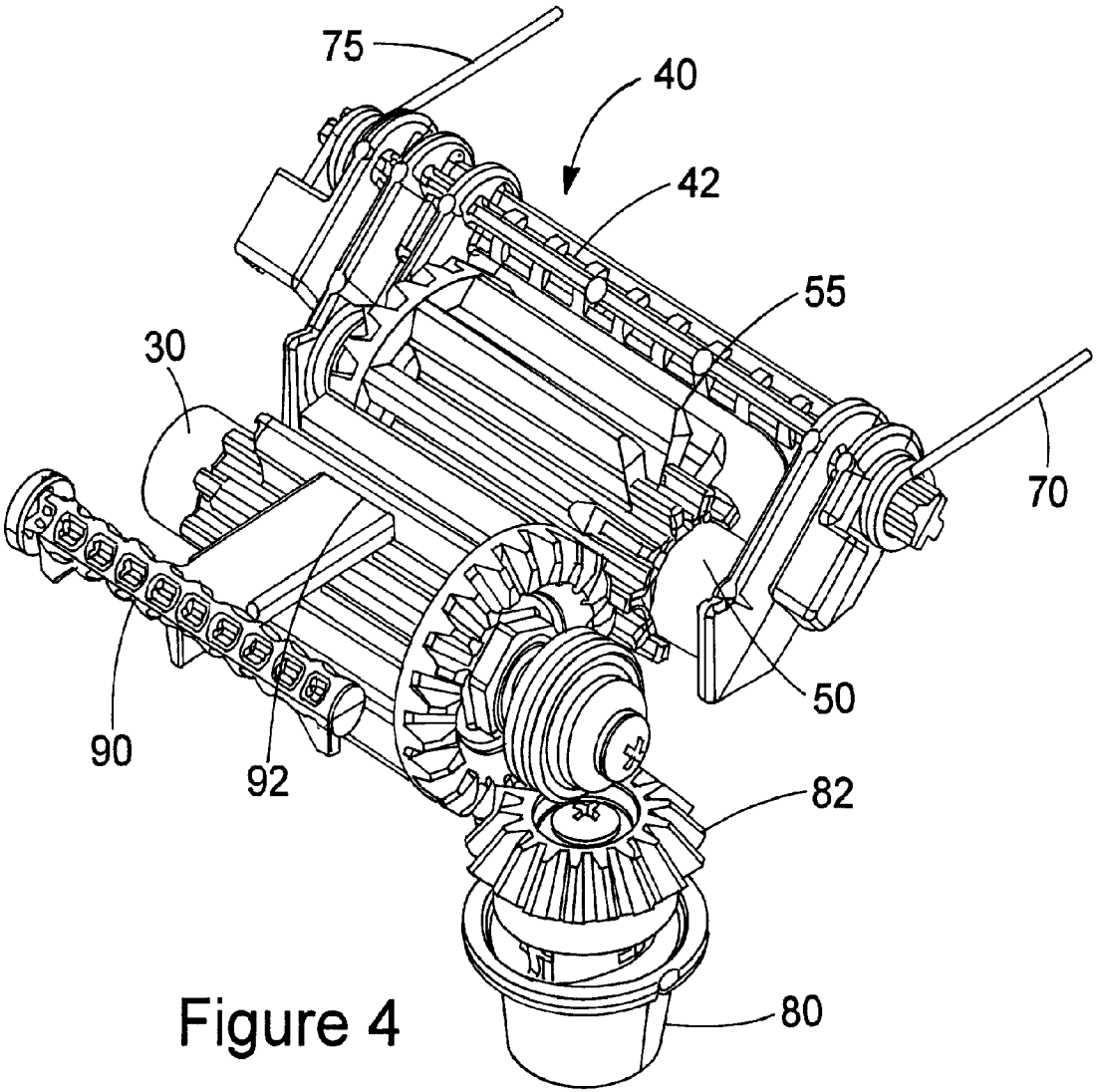
FIG. 4 is a perspective view from above of the FIG. 1 embodiment shown apart from the dispenser.

As best seen in FIGS. 3 and 4, the braking assembly 10 might also include anti-reverse features. As recognized by those of ordinary skill in the art, the braking assembly 10 of the present invention is designed to dispense paper from a paper source to an end user. To keep the braking assembly 10 from being able to run counter to the designed direction, in a presently preferred embodiment, there is a gravity actuated pawl 90 that rotates on an axis 90A parallel to the axes of rotation 30A and 50A for the first and second gears 30, 50. Pawl 90 is arranged such that as material is being dispensed, the first gear 30 rotates away from the free end 92 of the pawl 90. If the first gear 30 were to attempt to spin in a direction towards the pawl 90, the pawl 90 will engage one of the teeth 35 of the first gear 30 preventing the first gear 30 from further rotation in that direction. Although a pawl is described herein, nevertheless, as recognized by those of ordinary skill in the art, other mechanisms might be used to ensure that the braking assembly 10 rotates in only one direction.

While the present invention has been described in connection with various preferred embodiments thereof, it is to be understood that those embodiments are provided merely to illustrate the invention, and that the invention might readily be varied within the scope of the appended claims.

We claim:

1. A dispenser for dispensing a continuous feed material, said dispenser comprising:

a housing;

a first gear having a first plurality of teeth, mounted in said housing, and being rotatable about a first axis;

a chassis connected to said housing;

a second gear having a second plurality of teeth, mounted on said chassis, and being rotatable about a second axis that is parallel to the first axis, wherein said first and second pluralities of teeth are configured to intermesh with each other to allow continuous feed material to pass therethrough;

a spring connected to said chassis and configured to apply a biasing force to said second gear to bias said second gear towards said first gear;

a feed advancer coupled to said first gear or said second gear; and a brake connected to one of said first or second gears, wherein the brake is adjustable and configured to apply a braking force directly to the gear to which the brake is connected so as to control an amount of force required to rotate the gear to which the brake is connected.

2. The dispenser as claimed in claim 1, wherein said chassis pivots about a third axis spaced apart from and parallel to said second axis.

3. The dispenser as claimed in claim 2, wherein said chassis includes an elongate main body portion having first and second ends, and first and second arms extending from said elongate main body portion, said second gear being held between said first and second arms.

4. The dispenser as claimed in claim 3, further comprising a second spring, the springs being torsion springs connected to said first and second ends of said elongate main body that bias said chassis so as to maintain said first gear and said second gear adjacent to each other.

5. The dispenser as claimed in claim 1, wherein the brake comprises a resilient member mounted on an axle of said one of said first or second gears and a screw threaded into said axle of said one of said first or second gears, wherein loosening and tightening of said screw varies compression forces on the resilient member so as to adjust the amount of force required to rotate said one of said first or second gears.

6. The dispenser as claimed in claim 5, further comprising a device configured for limiting rotation of said first gear in only one direction.

7. The dispenser as claimed in claim 6, wherein said device configured for limiting rotation of said first gear in only one direction comprises an anti-reverse pawl that engages a tooth of said first gear.

8. The dispenser as claimed in claim 1, wherein said feed advancer is a manual feed knob connected to said one of said first or second gears.

9. The dispenser as claimed in claim 8, wherein said manual feed knob rotates about a feed knob axis that is perpendicular to one of the first axis or the second axis.

10. The dispenser as claimed in claim 1, further comprising a dispenser main housing, said dispenser main housing being connected to said housing and being configured to hold a supply of continuous feed material that is to be fed through said first and second gears and be dispensed.

11. The dispenser as claimed in claim 1, wherein the braking force is an axial force.

12. A braking assembly for dispensers that dispense a continuous feed material, said braking assembly comprising:

a braking assembly housing;

a first gear having a first plurality of teeth, mounted in said braking assembly housing, and being rotatable about a first axis;

a chassis connected to said braking assembly housing;

a second gear having a second plurality of teeth, mounted on said chassis, and being rotatable about a second axis that is parallel to the first axis, wherein said first and second pluralities of teeth are configured to intermesh with each other to allow continuous feed material to pass therethrough;

a spring connected to said chassis and configured to apply a biasing force to said second gear to bias said second gear towards said first gear;

a feed advancer coupled to said first gear or said second gear; and a brake connected to said first gear configured to apply a braking force directly to the first gear so as to control an amount of force required to rotate said first gear.

13. The braking assembly as claimed in claim 12, wherein said brake comprises a wave washer mounted on an axle of said first gear and a screw threaded into said axle of said first gear, said screw varying an amount of compression on said wave washer so as to vary the amount of force required to rotate said first gear.

14. The braking assembly as claimed in claim 12, wherein said brake comprises one of a spring or a resilient material configured to abut against an axle of said first gear, compression or expansion of said spring or resilient material being effective to vary the amount of force required to rotate said first gear.

15. The braking assembly as claimed in claim 12, further comprising an anti-reverse mechanism that limits rotation of said first gear in only one direction.

16. A braking assembly for dispensers that dispense a continuous feed material, said braking assembly comprising:

a support structure;

a first toothed gear connected to said support structure, said first gear being fixed except for rotation about a first axis;

a movable chassis connected to said support structure;

a second toothed gear held by said chassis, said second gear being configured to move with said chassis and to rotate about a second axis that is parallel to the first axis, wherein said first and second pluralities of teeth are configured to intermesh with each other to allow continuous feed material to pass therethrough;

a feed advancer coupled to said first gear or said second gear; and a brake directly contacting said first gear or said second gear and configured to vary an amount of force required to rotate said first and second gears.

17. The dispenser as claimed in claim 16, wherein said brake is configured to increase and decrease an amount of braking force applied on said first gear so as to control freedom of rotation of said first gear.

18. The braking assembly as claimed in claim 17, wherein the braking force is an axial force.

19. The braking assembly as claimed in claim 16, wherein said brake comprises a wave washer mounted on an axle of said one of said first or second gears and a screw threaded into said axle of said one of said first or second gears, said screw varying an amount of compression on said wave washer so as to vary the amount of the braking force applied on said one of said first or second gears.

* * * * *